United States Patent [19]

Herbstman et al.

[11] Patent Number: 5,057,123

[45] Date of Patent: Oct. 15, 1991

[54] METHOD OF STABILIZING DIESEL FUELS

[75] Inventors: Sheldon Herbstman, New City; Theodore E. Nalesnik, Wappingers Falls, both of N.Y.

[73] Assignee: Texaco Inc., White Plains, N.Y.

[21] Appl. No.: 528,503

[22] Filed: May 25, 1990

[51] Int. Cl.[5] ..... C10L 1/10; C10L 1/22

[52] U.S. Cl. ..... 44/334; 44/430; 44/432; 252/397; 252/399; 252/405

[58] Field of Search ..... 44/62, 63, 412, 430, 44/432, 334; 252/397, 399, 405

[56] References Cited

U.S. PATENT DOCUMENTS 4,032,700 6/1977 Song et al. ..... 252/51.5 R 4,698,169 10/1987 Andress, Jr. et al. ..... 252/49.6

*Primary Examiner*—Prince E. Willis

*Assistant Examiner*—M. Nuzzolillo

*Attorney, Agent, or Firm*—Robert A. Kulason; James J. O'Loughlin; Dominick G. Vicari

[57] ABSTRACT

A method of stabilizing a diesel fuel formulation by substantially minimizing the oxidation thereof is disclosed. In particular, at least one amine containing copolymer is incorporated into the diesel fuel formulation in an amount sufficient to improve the storage stability and, also, substantially minimize the oxidation thereof. The method of this invention is particularly well suited for substantially minimizing the high temperature oxidation of diesel fuels.

8 Claims, No Drawings

METHOD OF STABILIZING DIESEL FUELS

BACKGROUND OF THE INVENTION

1. Field of the Invention

This invention relates to a method of stabilizing diesel fuels by improving the storage stability and, also, preventing oxidation of such fuels.

2. Description of the Background Art

One of the problems associated with diesel fuels is excessive sediment formation, which is ascribed to oxidation under field storage conditions. The presence of sediment can interfere with the normal operation of diesel engines and can cause severe damage to engine parts. Diesel fuels which are susceptible to oxidation are typically characterized as unstable.

U.S. Pat. No. 4,698,169 describes a product made by reacting an alkenylsuccinic compound with an arylamine and an alkanolamine, an aminomethane or a hindered alcohol. The product is reported as providing dispersant and antioxidant activity to lubricant compositions when incorporated therein.

U.S. Pat. No. 4,089,794 describes substantially saturated polymers comprising ethylene and one or more $C_3$ to $C_{28}$ alpha-olefins which have been solution-grafted in the presence of a free-radical initiator with an ethylenically-unsaturated carboxylic acid material at an elevated temperature, preferably in an inert atmosphere, and thereafter reacted with a polyfunctional material reactive with carboxy groups, such as (a) a polyamine, (b) a polyol or (c) a hydroxyamine or mixtures thereof, to form polymeric reaction products. The reaction products are described as sludge-dispersing additives for hydrocarbon fuels and lubricating oils.

U.S. Pat. No. 4,032,700 describes a process for preparing aminated polymers which includes halogenating a copolymer of ethylene, a $C_3$ to $C_{18}$ a straight or branched chain alpha-chain olefin and a $C_5$ to $C_{14}$ acyclic or alicyclic non-conjugated diolefin and thereafter reacting said copolymer with an amine. The additives so produced are described as dispersants for hydrocarbon fuels or lubricants and as multifunctional dispersant-viscosity index improvers for lubricants. There is no express or implied recognition of using the additives as antioxidants in diesel fuel formulations to improve the stability of same.

U.S. Pat. No. 4,919,684 describes a stable middle distillate fuel-oil composition which includes (a) a major portion of a middle distillate fuel oil and (b) a minor amount, as a storage stabilizing additive, of N-3-(3,5-di-t-butyl-5-hydroxybenzene) propyl succinimide of a copolymer and maleic anhydride graft.

U.S. Pat. No. 4,919,685 describes a stable middle distillate fuel-oil composition which includes (a) a major portion of a middle distillate fuel oil and (b) a minor amount, as a storage stabilizing additive, of an aliphatic N(N',N'-dimethylaminopropyl) succinimide of a copolymer and maleic anhydride graft.

It is, therefore, our understanding that a method for stabilizing diesel fuels by substantially eliminating oxidation and, particularly, high temperature oxidation of such fuels, in the manner described below has heretofore been unavailable.

SUMMARY OF THE INVENTION

Accordingly, the present invention relates to a method of stabilizing a diesel fuel formulation by substantially minimizing the oxidation of said fuel formulation, said method comprising incorporating at least one amine containing copolymer in said fuel formulation in an amount sufficient to substantially minimize the oxidation of said fuel formulation. The method of this invention is particularly well suited for minimizing high temperature oxidation of diesel fuels.

DESCRIPTION OF THE PREFERRED EMBODIMENTS

The basic copolymers used to prepare the additives employed in the method of this invention are prepared from ethylene, $C_3$ to $C_8$ alpha-olefins or mixtures thereof. By way of illustration, the $C_3$ to $C_{18}$ alpha-olefins can be selected from propylene, 1-butene, 1-pentene, 1-hexene, 1-heptene, 1-decene, 1-dodecene, etc. Preferably, the copolymers are prepared from ethylene and a $C_3$ to $C_8$ alpha-olefin or a mixture thereof and, most preferably, the $C_3$ to $C_8$ olefin is propylene.

Optionally, the basic copolymer structure can be prepared by employing, in addition to those monomers identified above, a diene as a third component. Accordingly, in those instances where the diene is optionally employed, the term "copolymer" is intended to include the diene-containing copolymers. The diene can be selected from (a) straight chain acyclic dienes, such as 1,4-hexadiene, 1,5-heptadiene and 1,6-octadiene; (b) branched chain acyclic dienes, such as 5-methyl-1, 4-hexadiene, 3,7-dimethyl 1,6-octadiene, 3,7-methyl 1,7-octadiene, and the mixed isomers of dihydromyrcene and dihydroocimene; (c) single ring alicyclic dienes, such as 1,4-cyclohexadiene, 1,5-cyclo-octadiene, 1,5-cyclododecadiene, 4-vinylcyclohexene, 1-allyl 4-isopropylidene cyclohexane, 3-allyl-cyclopentene, 4-allylcyclohexene and 1-isopropenyl 4(4-butenyl)cyclohexane; (d) multi-single ring alicyclic dienes, such as 4,4'-dicyclopentenyl and 4,4'-dicyclohexenyl dienes; and (e) multi-ring alicyclic fused and bridged ring dienes, such as tetrahydroindene, methyl tetrahydroindene, dicyclopentadiene, bicyclo(2,2,1) hepta 2,5-diene, alkenyl, alkylidene, cycloalkenyl and cycloalkylidene norbornenes, such as 5-methylene-2-norbornene, 5-ethylidene-2-norbornene, 5-methylene-6-methyl-2-norbornene, 5-methylene-6,6-dimethyl-2-norbornene, 5-propenyl-2-norbornene, 5-(3-cyclopentenyl)-2-norbornene and 5-cyclohexylidene-2-norbornene. Mixtures of the aforesaid dienes may also be used.

The polymerization reaction used to form the basic copolymer structure can be carried out in batch, staged or continuous reactors and is conducted in the presence of a Ziegler-Natta catalyst. In general, the catalyst compositions used to prepare these copolymers comprise a principal catalyst consisting of a transition metal compound from Groups IV(b), V(b) and VI(b) of the Periodic Table of Elements, particularly compounds of titanium and vanadium, and organometallic reducing compounds from Groups II(a), II(b) and III(a), particularly organoaluminum compounds which are designated as cocatalysts. Preferred principal catalysts of vanadium have the general formula $VO_zX_t$ wherein z has a value of 0 or 1 and t has a value of 2 to 4. X is independently selected from halogens having an atomic number equal to or greater than 17, acetylacetonates, haloacetylacetonates, alkoxides and haloalkoxides. Non-limiting examples are: $VOCl_3$; $VO(AcAc)_2$; $VOCl(OBu)$; $V(AcAc)_3$; and $VOCl_2(AcAc)$ where Bu is n-butyl or isobutyl, and (AcAc) is an acetylacetonate.

Preferred cocatalysts have the general formula $ALR'_mX'_n$, where R' is a monovalent hydrocarbon radical selected from the group consisting of $C_1$ to $C_{12}$ alkyl, alkylaryl, arylalkyl and cycloalkyl radicals, X' is a halogen having an atomic number equal to or greater than 17, m is a number from 1 to 3, and the sum of m and n is equal to 3. Non-limiting examples of useful cocatalysts are: $Al(Et)_3$; EtAlCl; $EtAlCl_2$ and $Et_2Al_2Cl_3$.

Also, in a preferred embodiment, the polymerization reaction is conducted in a solvent medium. The polymerization solvent may be any suitable inert organic solvent that is liquid under reaction conditions for solution polymerization of the aforementioned monomers. Examples of satisfactory hydrocarbon solvents include straight chain paraffins having from 5 to 8 carbon atoms, with hexane being preferred. Aromatic hydrocarbons, preferably aromatic hydrocarbons having a single benzene nucleus, such as benzene, toluene and the like; and saturated cyclic hydrocarbons having boiling point ranges approximating those of the straight chain paraffinic hydrocarbons and aromatic hydrocarbons described above are particularly suitable. The solvent selected may be a mixture of one or more of the foregoing hydrocarbons. It is desirable that the solvent be free of substances that will interfere with Ziegler-Natta polymerization reactions.

Suitable times of reaction will generally be in the range from 1 to 300 minutes, temperatures will usually be in the range of 0° C. to 100° C., and pressures from atmospheric to 160 psig are generally used. Monomer feed to the reactor per 100 parts by weight of solvent may be in the range of 2 to 20 parts by weight of ethylene, 4 to 20 parts by weight of the $C_3$ to $C_{18}$ alpha-olefin and 0.1 to 10 parts by weight of the diene.

Principal catalyst, $VOCl_3$ for example, prediluted with solvents is fed to the reactor so as to provide a concentration in the range of 0.1 to 5.0 millimoles per liter. Cocatalyst, for example, $Et_2Al_2Cl_3$, is at the same time fed to the reactor in an amount equal to from 2.0 to 20.0 moles of cocatalyst per mole of principal catalyst.

The basic copolymers used in the method of the present invention can be selected from commercially available products, such as VISTALON, an elastomeric copolymer of ethylene, propylene and 5-ethylidene, 2-norbornene, marketed by Exxon Chemical Co. and Nordel, a copolymer of ethylene, propylene and 1,4-hexadiene, marketed by E. I. duPont de Nemours & Co., Wilmington, Del.

In a most preferred embodiment, the basic copolymer employed is Ortholeum 2052, an ethylene-propylene-hexadiene copolymer with about 5 weight percent unsaturation, which is also marketed by E. I. duPont de Nemours & Co. In fact, the preferred additives used in the method of this invention are aminated and chlorided Ortholeum 2052 derivatives as is discussed with particularity hereinbelow.

The next step in preparing the additives used in the method of this invention involves halogenating the basic copolymer. The halogenation of the copolymer which, again, can include the diene-containing copolymer, can be carried out by simply dissolving the polymer in a solvent, preferably a solvent which is substantially inert to the halogen material, and adding halogen, e.g., gaseous chloride, liquid bromine, into the solution, preferably at rather low temperatures, e.g., from about 0° C. to about 100° C. Primarily depending on the amount of halogen added and the number of double bonds available, 0.1 to 10.0, e.g., 0.2 to 8.0 weight percent halogen, e.g., Cl or Br, based on the weight of halogen containing copolymer, can be added to the polymer. In halogenation, the chlorine tends to react allylically, while the bromine tends to be incorporated by addition. If the reaction is carried out in an inert volatile solvent, then a non-volatile oil can be later added to the reaction product solution and the volatile solvent evaporated to thereby form an oil concentrate of the halogen containing diolefin copolymer for further handling. Alternatively, isolation of the halogenated polymer may be readily carried out, e.g., by precipitation in media such as acetone or isopropanol or by stripping with steam, etc.

In general, these techniques are known in the art; for example, bromination of copolymers of ethylene, a $C_3$ to $C_8$ alpha-olefin and a $C_3$ to $C_{14}$ non-conjugated diolefin is illustrated in U.S. Pat. No. 3,524,826.

The chlorinated copolymers or diolefin copolymers are next aminated to produce the additives used in the method of this invention. In general, useful amines include amines having carbon numbers of about 1 to about 60, e.g., 4 to 20, total carbon atoms and about 1 to about 12, e.g., to 6 nitrogens, which amines may be hydrocarbyl amines or may include other groups, e.g., hydroxy groups, amide groups, imidazoline groups, etc. Preferred amines are aliphatic, saturated amines, including those of the general formulae:

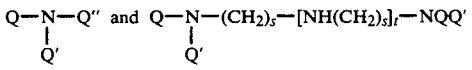

wherein Q, Q' and Q'' are independently selected from hydrogen, $C_1$ to $C_{12}$ straight or branched chain alkyl radicals or hydroxy alkyl radicals, and Ω-amino $C_2$ to $C_{12}$ alkylene radicals, s is a cardinal number from 2 to 6, preferably 2 to 4, and t is a cardinal number from 0 to 10, preferably 2 to 6.

Non-limiting examples include: ammonia; dodecylamine, di-(2-ethylhexyl)amine;di(trimethylene) triamine; 1,2-ethylene diamine, 1,2-propylene diamine; 1,3-propylene diamine; diethylene triamine; triethylene tetraamine; tetraethylene penta-amine; di-(1,3-propylene) triamine; di-(1,4-butylene) triamine; xylylene diamine; N,N-dimethyl 1,3-diaminopropane and N,N-di-(2-aminoethyl)ethylene diamine, 4-methyl imidazoline; 1,3-bis(2-aminoethyl) imidazoline; pyrimidine; diethanolamine; etc.

Other useful compounds include alicyclic diamines, such as 1,2-di(aminomethyl) cyclohexane, and heterocyclic nitrogen compounds, such as the N-aminoalkyl piperazine of the general formula:

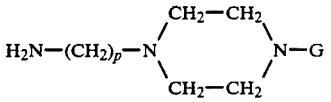

wherein G is independently selected from hydrogen and omegaaminoalkyl radicals of from 1 to 3 carbon atoms; and p is an integer from 1 to 4. Non-limiting examples include: N-(2-aminoethyl piperazine; N-(2-aminopropyl) piperazine; and N,N'-di-(2-aminoethyl) piperazine.

Commercial mixtures of amines may be used in the practice of this invention. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, usually of 2 to 4 carbons including polyalkyleneamines, such as tetraethylene pentamine and its homologs including piperazines. Low cost polyethyleneamine mixtures, which have a composition generally corresponding to tetraethylene pentamine and its higher analogs, are commercially available.

Reaction of the halo-copolymer, usually dissolved in a solvent or diluent oil, with the amine component will typically be carried out at a temperature in the range of about 20° C. to about 200° C. for about 0.1 to about 100 hours, at atmospheric pressure in the case of high boiling amines or under superatmospheric pressure in the case of low boiling amines, such as ethylene diamine. In either case, it is desirable to maintain an inert atmosphere, such as a nitrogen atmosphere, in the reaction mixture. The reaction can be carried out in the presence of a base, such as a metal oxide, hydroxide, etc., preferably an alkaline earth metal oxide, e.g., CaO or BaO to absorb any hydrochloric acid that may evolve, although good results have been obtained without the presence of the base. If the metal base is used, then, of course, it can be later removed by centrifuging or filtration at the end of the reaction.

While any of the reaction products made in the manner described above can be employed in the method of this invention, it is to be understood that the aminated Ortholeum 2052 derivatives are preferred.

Among such derivatives, the additives employed in the method of this invention most preferably include aminopropyl-morpholine Ortholeum, dimethylaminopropylamino Ortholeum, N-phenylphenylenediamine Ortholeum, N-aminopropyl-N'-phenylphenylenediamine Ortholeum and mixtures thereof. The foregoing compounds can be, and are preferably, halogenated as discussed above.

In accordance with the method of this invention, at least one of the polymer amine additives described above are incorporated, in a conventional manner, into a diesel fuel formulation to stabilize the fuel formulation by substantially minimizing the oxidation thereof and, as a result, minimizing the degree of excessive sediment formation. As stated earlier, the method of this invention is particularly well suited for substantially minimizing the high temperature oxidation of diesel fuels. The term "high temperature" is generally intended to include temperatures ranging from about 100° C. to about 400° C. and, most preferably, from about 250° C. to about 350° C.

The additives are incorporated into the diesel fuel formulation in an amount of about 5 to about 500 pounds per thousand barrels (PTB) and, preferably in an amount of about 200 to about 300 PTB.

The following Examples I–V are provided to further illustrate preferred embodiments of preparing the additives used in the method of this invention; these examples should not be construed as limiting the present invention in any way.

EXAMPLE I

In this example, a sample of chlorided Ortholeum 2052 was prepared. Specifically, 1000 ml of hexane and 500 grams of ⅛-inch cubes of Ortholeum 2052 were added to a 5 liter reaction flask which was equipped with a mechanical stirrer, thermometer, a gas inlet bubbler and a gas outlet to a chlorine trap. The contents of the flask were stirred at room temperature until the Ortholeum 2052 dissolved. A 2:3 volumetric mixture of nitrogen:chlorine gas was bubbled through the solution at room temperature for one hour and at a flow rate of 250 ml/min while the solution was rapidly stirred. A rise in temperature from room temperature to 35° C. was observed. After the introduction of the nitrogen:-chlorine gas mixture was terminated, the solution was flushed with nitrogen for one hour with stirring. To this solution was added 3340 grams of SNO-100 base oil followed by removal of hexane under vacuum. The base oil was added in an amount such that the final polymer content in the oil was 13 weight percent.

EXAMPLE II

In this example, a sample of aminopropylmorpholine Ortholeum (APMO) VI improver was prepared. A 250 gram portion of the chlorided Ortholeum 2052 prepared in Example I was dissolved in solvent neutral oil 100 and was added to a 500 ml flask equipped with a mechanical stirrer, thermometer, and a nitrogen inlet and outlet for a nitrogen blanket. The temperature of the solution was raised to 160° C. and, while the solution was being stirred, 1.6 grams of aminopropylmorpholine and 6.0 grams of calcium oxide were added to the solution. The reagents were permitted to react for 72 hours at 160° C. under nitrogen. The solution was thereafter cooled to room temperature and reaction product dissolved in 500 ml of hexane and then centrifuged to remove any unreacted calcium oxide. Finally, the hexane was removed from the aminopropylmorpholine Ortholeum oil solution under vacuum at 150° C.

EXAMPLE III

In this example, a sample of dimethylaminopropylamine bound Ortholeum VI Improver was prepared in substantially the same manner as the APMO was prepared in Example II. In this example, however, a 230 gram portion of the chlorided rubber oil solution was added to the 500 ml flask. Also, 5.6 grams of the calcium oxide were employed and 1.5 grams of dimethylaminopropylamine (as opposed to 1.6 grams of aminopropylmorpholine) were employed.

EXAMPLE IV

In this example, a sample of N-phenylphenylenediamine bound Ortholeum VI improver was prepared in substantially the same manner as the APMO was prepared in Example II. In this example, however, a 500 gram portion of the chlorided rubber oil solution was added to a 1 liter reaction flask. Also, 12.0 grams of the calcium oxide were employed and 4.0 grams of N-phenylphenylenediamine (as opposed to 1.6 grams of aminopropylmorpholine) were employed. Finally, in this example, the reaction product was dissolved in 1000 ml of hexane.

EXAMPLE V

In this example, a of N-aminopropyl-N'-phenylphenylenediamie bound Ortholeum VI improver was prepared in substantially the same manner as the APMO was prepared in Example II. In this example, however, 1.8 grams of N-aminopropyl-N'-phenylphenylenediamine (as opposed to 1.6 grams of aminopropylmorpholine) were employed. Also, in this example, as in Example IV, a 1 liter reaction flask and 1000 ml of hexane were employed.

The reaction products produced in Examples II–V were incorporated into a diesel fuel formulation which was tested for high temperature oxidation stability using the Potential Deposit Test; the results are reported in Table I. Specifically, a 12 weight percent sample of the reaction product was dissolved in a commercially available diesel fuel to provide a fuel test sample. The fuel sample was heated for two hours at 275° C. while air was bubbled through the fuel at a rate of 3 liters per hour. At the end of the heating period, the fuel was cooled to 77° F. for one hour and filtered through a 9.6 sq.cm. area of a No. 1 Whatman filter paper. The bulk of the insoluble material deposited for the filter paper is visually compared to the deposit code which has been correlated with actual field test results. Deposit code values of 4 or higher fail the test, i.e., demonstrate poor high temperature oxidation and storage stability. The foregoing test is a modification of ASTM D-2274 which is believed by those skilled in the art to correlate with field storage conditions.

TABLE I

| Example No. | Concentration (PTB) | Potential Deposit Test Results |
|---|---|---|
| Base Fuel | — | 4,4 |
| II | 40 | 2,2 |
| | 80 | 2,2 |
| | 200 | 2,1 |
| III | 40 | 2,1 |
| | 80 | 1,1 |
| | 200 | 2,2 |
| IV | 40 | 2,2 |
| | 80 | 2,2 |
| | 200 | 2,2 |
| V | 40 | 2,2 |
| | 80 | 2,2 |
| | 200 | 2,2 |

As these data demonstrate, the animated Ortholeum 2052 derivatives employed in the method of the present invention exhibit significant oxidation stabilizing activity for diesel fuels and, as a result, prevent the buildup of extensive sediment formation under storage conditions or under high temperature conditions in the presence of air.

What is claimed is:

1. A method of stabilizing a diesel fuel formulation by substantially minimizing the oxidation of said fuel formulation, said method comprising incorporating at least one amine containing copolymer in said fuel formulation in an amount sufficient to substantially minimize the high temperature oxidation of said fuel formulation, said amine containing copolymer is selected from the group consisting of (a) an aminopropylmorpholine ethylene-propylene-hexadiene copolymer having about 5 weight percent unsaturation, (b) a N-phenylphenylenediamine ethylene-propylene-hexadiene copolymer having about 5 weight percent unsaturation, (c) a N-aminopropyl-N'-phenylphenylenediamine ethylene-propylene-hexadiene copolymer having about 5 weight percent unsaturation, and (d) mixtures thereof.

2. The method of claim 1 wherein said amine containing copolymer is incorporated into said fuel formulation in an amount of about 5 to about 500 parts per thousand barrels.

3. The method of claim 2 wherein said amine containing copolymer is incorporated into said fuel formulation in an amount of about 200 to about 300 pounds per thousand barrels.

4. The method of claim 1 wherein said oxidation is substantially minimized at a temperature of about 100° C. to about 400° C.

5. The method of claim 1 wherein said copolymer is prepared from ethylene, a $C_3$ to $C_{18}$ a alpha-olefin or mixtures thereof.

6. The method of claim 1 wherein said copolymer further includes at least one diene.

7. The method of claim 1 wherein said amine containing copolymer further includes a halogen.

8. The method of claim 7 wherein said halogen includes chlorine or bromine.

* * * * *